United States Patent [19]

Sprung

[11] Patent Number: 5,035,037

[45] Date of Patent: Jul. 30, 1991

[54] ADJUSTABLE EXPANDING RUBBER TIRE ROLLER FOR PAPER SCORING MACHINERY

[76] Inventor: Ralph D. Sprung, 244 E. Dexter St. #4, Covina, Calif. 91723

[21] Appl. No.: 70,387

[22] Filed: Jul. 7, 1987

[51] Int. Cl.[5] ..... B21B 31/32

[52] U.S. Cl. ..... 29/113.1; 29/419; 29/125; 29/130

[58] Field of Search ..... 29/119, 130, 113, 125; 101/415.1; 226/191, 175

[56] References Cited

U.S. PATENT DOCUMENTS

| | | | |
|---|---|---|---|
| 2,066,031 | 12/1936 | Cowan | 29/119 |
| 2,210,500 | 8/1940 | Rohland | 29/119 |
| 2,342,159 | 2/1944 | Moran | 29/119 |
| 2,488,764 | 11/1949 | Courtney | 29/119 |
| 3,106,767 | 10/1963 | Fox | 29/119 |
| 4,423,541 | 1/1984 | Mrshall | 29/117 |
| 4,530,690 | 7/1985 | Logan | 29/119 |

FOREIGN PATENT DOCUMENTS

| | | | |
|---|---|---|---|
| 1059145 | 6/1952 | France | 29/119 |

*Primary Examiner*—Irene Cuda

*Attorney, Agent, or Firm*—Boniard I. Brown

[57] ABSTRACT

An adjustable diameter roller useful for feeding and scoring or creasing paper and for other applications. The roller has a ring-like elastic tire coaxially surrounding a hub between coaxial circumferential shoulders on the hub having confronting annular shoulder faces which are tapered to diverge radially outwardly of the hub and abut similarly tapered side faces on the tire, and means for effective relative axial adjustment of the shoulders toward and away from one another to effect radial expansion and contraction of the tire and thereby adjust its outer diameter.

2 Claims, 1 Drawing Sheet

FIG—.1
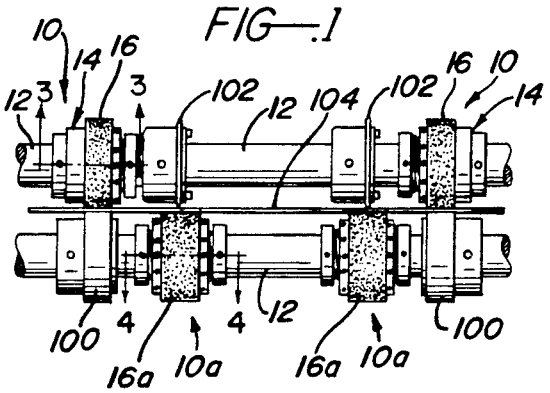
FIG—.2
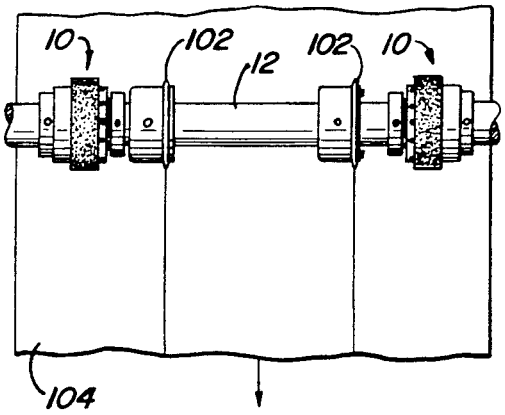
FIG—.3
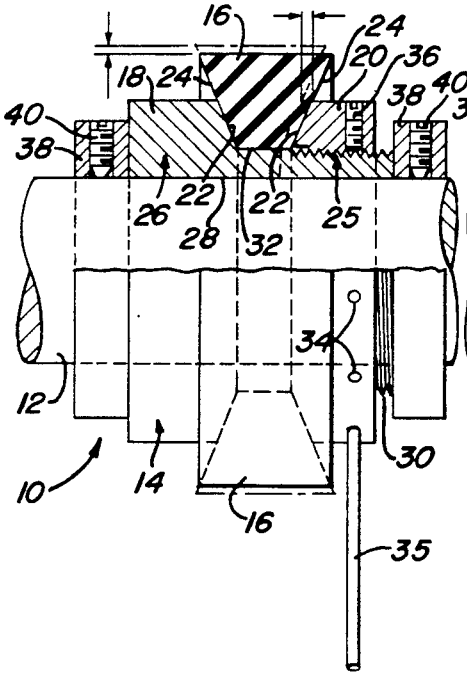
FIG—4
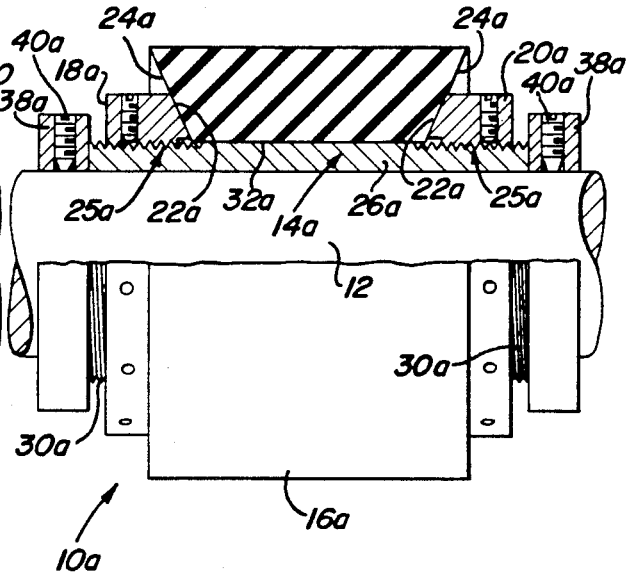

ADJUSTABLE EXPANDING RUBBER TIRE ROLLER FOR PAPER SCORING MACHINERY

BACKGROUND OF THE INVENTION

This invention relates generally to rollers of the class which are used to handle sheet material, particularly paper, paperboard, cardboard and the like. The invention relates more particularly to an adjustable diameter roller of this class.

DESCRIPTION OF THE PRIOR ART

As well appears from the ensuing description, the principles of this invention may be used in rollers for handling various kinds of sheet material and for performing various sheet handling operations. However, the invention is particularly concerned with feed rollers for feeding paper, paperboard, cardboard and the like, collectively referred to herein simply as paper, and with scoring rollers for scoring or creasing paper. For this reason, the invention will be described in this context.

Paper handling machines, such as machines for printing, scoring, folding, perforating or otherwise operating on paper have feed roller assemblies for feeding the paper edgewise thru the machines. A common feed roller assembly has opposing rollers between which the paper passes. At least one roller is driven to feed the paper. This driven feed roller is commonly referred to as a pull-out roller. A typical pull-out roller has a central hub coaxially mounting at least one resilient collar or tire, and in some cases a number of axially spaced resilient collars or tires, which contact the paper to be fed. These tires are commonly called pull-out tires. The opposing rollers are spaced so that the driven feed roller contacts the paper with sufficient contact pressure to feed the paper edgewise when the feed roller is driven in rotation.

The existing paper feed rollers of which I am aware have resilient pull-out tires of fixed diameter. The only way of adjusting such a feed roller relative to its opposing roller to adjust the contact pressure of the feed roller with the paper is to relatively adjust the rollers themselves. This type of feed roller gives rise to a variety of problems as follows.

Adjustment of the rollers to achieve the proper contact pressure of the driven feed roller with the paper is extremely difficult. Excessive contact pressure of the rollers with printed paper in a printing machine, for example, can cause smearing of the ink on the paper. Insufficient contact pressure, on the other hand, will result in improper paper feeding. Proper contact pressure is particularly difficult if not impossible to achieve with a driven feed roller having a number of axially spaced pull-out tires, owing to slight differences in the tire diameters and the inability to individually adjust the tire diameters.

A related problem arises as a result of wearing of the pull-out tire(s), and particularly uneven wearing of multiple tires on the same feed or pull-out roller. Compensation for such wear by bodily adjustment of the driven feed roller and its opposing roller is difficult or impossible to accomplish. In this case, the inability to accurately compensate for uneven wear of several pull-out tires on the same feed roller results in uneven contact pressure of the tires with the paper being fed. This uneven contact pressure, in turn, causes uneven, i.e., non-linear, feeding of the paper which is totally unacceptable, particularly in paper handling machines, such as printing, perforating, folding and scoring machines.

The existing paper scoring or creasing machines commonly utilize two different types of creasing or scoring devices. Each type comprises a scoring roller and an opposing circular blade-like scoring wheel between which the paper to be scored or creased passes. In one type, the scoring roller has two rigid coaxial collars of the same diameter arranged end to end with a narrow intervening gap in the plane of the scoring wheel. As the paper passes between the scoring roller and wheel, the latter deforms the paper slightly into the gap between the roller collars to crease or score the paper. The scoring wheel and roller are laterally adjustable relative to one another and the gap between the scoring roller collars is adjustable in width to vary the depth and width of the crease produced in the paper.

This type of scoring device has the disadvantage that when running heavy (i.e., relatively thick) or coated paper, the crease produced is relatively sharp and exhibits a highly undesirable cracking effect, particularly if the paper is folded along the crease.

In another type of paper scoring device, the scoring roller has an elastic or resilient insert within the gap between the rigid roller collars. This scoring device produces a superior crease to that produced by the scoring device without the resilient insert but has the disadvantage of requiring a somewhat cumbersome means for axially adjusting the roller collars to vary the roller gap width because of the necessity of squeezing the gap insert when narrowing the gap.

SUMMARY OF THE INVENTION

This invention provides an adjustable diameter roller which is particularly suited for use as a paper feed roller and a paper scoring or creasing roller and which avoids the above noted and other deficiencies of the existing feed and scoring or creasing rollers. It will become evident as the description proceeds, however, that the adjustable diameter roller of the invention may be used for other purposes.

Simply stated, the adjustable diameter roller of the invention comprises a rotary hub and an elastic tire coaxially surrounding the hub between a pair of coaxial annular shoulders on the hub. These shoulders have confronting annular shoulder faces which are radially, and preferably conically, tapered, to diverge in the radially outward direction of the roller. The side faces of the elastic tire are tapered at substantially the same angle as the shoulder faces on the hub and contact these shoulder faces. Means are provided for axially adjusting one shoulder toward and away from the other shoulder or adjusting each shoulder axially toward and away from the other shoulder.

Relative axial adjustment of the shoulders toward one another urges the tapered shoulder faces against the similarly tapered side faces on the elastic tire. This produces an outward radial force on the tire about the full circumference of the tire and thereby radially expands the tire to a larger outside diameter. The tire is circumferentially stretched as it expands radially. The resulting elastic stress in the tire causes the latter to contract radially to a smaller outside diameter upon relative axial adjustment of the hub shoulders away from one another. This radial expansion and contraction of the tire occurs without any substantial lateral deformation of the outer peripheral surface of the tire.

One disclosed embodiment of the invention is a feed or pull-out roller for a paper handling machine which cooperates with an opposing feed roller to feed paper edgewise thru the machine. Another disclosed embodiment is a scoring or creasing roller which cooperates with an opposing scoring blade to score or crease paper. In each embodiment, the elastic tire of the roller is adjustable in diameter to adjust its contact pressure with the paper.

BRIEF DESCRIPTION OF THE DRAWINGS

FIG. 1 is a side elevation of a paper feeding and scoring roller assembly embodying adjustable diameter feeding and scoring rollers according to the invention;

FIG. 2 is a top plan view of the roller assembly in FIG. 1;

FIG. 3 is an enlarged view, partly in section, of the feed roller in FIG. 1; and FIG. 4 is an enlarged view, partly in section, of the scoring roller in FIG. 1.

DESCRIPTION OF THE PREFERRED EMBODIMENT

Turning first to FIG. 3, there is illustrated an adjustable diameter roller 10 according to the invention mounted on a rotary shaft 12. The roller has a hub 14 fixed to the shaft for rotation therewith and an elastic annular tire 16 coaxially surrounding and rotatable with the hub. Hub 14 has coaxial annular shoulders 18 and 20 at opposite sides of the tire 16. At the axially inner sides of the shoulders 18, 20 are facing annular shoulder faces 22 which are tapered, preferably conically tapered, to diverge in the radial outward direction of the hub. The annular side faces 24 of the tire 16 are tapered at substantially the same angle as the shoulder faces 22 and are disposed in face-to-face contact with the shoulder faces.

Means 25 are provided for effecting relative axial movement of the hub shoulders 18, 20 toward and away from one another. Relative movement of the shoulders toward one another urges their tapered shoulder faces 22 against the similarly tapered side faces 24 of the elastic tire 16. The resulting contact pressure of the shoulder faces against the tire faces produces an outward radial force on the tire which expands the latter radially to a larger diameter. As it expands radially outward, the tire 16 also expands or stretches circumferentially, thereby creating a circumferential elastic strain in the tire. As a consequence, relative axial adjustment of the hub shoulders 18, 20 away from one another results in circumferential contraction, and thereby also radial contraction of the tire 16 to a smaller outside diameter. The hub 14 and tire 16 are preferably sized so that the tire will contract to a minimum diameter at which the tire contacts the hub between the shoulders 18, 20 if the shoulders are separated sufficiently.

Referring now in more detail to FIG. 3, the roller hub 14 has a generally cylindrical body 26 with a central bore 28 which is sized to slidably receive the shaft 12. One end of the hub body 26 is threaded at 30. The opposite end of the body is radially enlarged to form the hub shoulder 18. Between the threaded end 30 and the shoulder 18 is smooth cylindrical surface 32 whose diameter is at least as large as the outside diameter of the threaded end to permit the tire 16 to be slipped over the latter end onto the surface 32.

Shoulder 20 comprises an internally threaded ring which is rotatably threaded on the threaded end 30 of the hub. Rotation of this ring in one direction advances the ring toward the hub shoulder 18. Rotation of the ring in the opposite direction retracts the ring away from the shoulder 18. Accordingly, the mating threads on the hub body 26 and the adjustable shoulder 20 together comprise the means 25 for relatively adjusting the shoulders 18, 20 toward and away from one another. The adjustable shoulder 20 has circumferentially spaced sockets 34 to receive a wrench 35 for turning the shoulder. A set screw 36 is threaded in the shoulder 20 to lock the latter against turning.

Hub 14 is fixed to shaft 12 in any convenient way. In FIG. 3, the hub is fixed against rotation on the shaft by means, not shown, and is fixed against axial movement along the shaft by collars 38 secured to the shaft by set screws 40. The roller 10 is adjustable along the shaft by releasing these set screws.

FIG. 4 illustrates a modified adjustable diameter roller **10*a* which is generally similar to the roller 10. For this reason, the various elements of the modified roller are designated by the same reference numerals, with the subscript a, as the corresponding elements of the roller 10**.

Roller **10*a* has a hub 14*a* including a cylindrical body 26*a* with opposite threaded ends 30*a* and a smooth cylindrical surface 32*a* between the ends. Threaded on the ends 30*a* are annular collars 18*a*, 20*a* which form annular shoulders on the hub. These shoulders have confronting annular shoulder faces 22*a* which are tapered, preferably conically tapered, to diverge radially outward. The inter engaging threads on the hub body 26*a* and shoulders 18*a*, 20*a* provide means 25*a* for relatively adjusting the shoulders toward and away from one another by adjusting either or each shoulder toward and away from the other shoulder. Each shoulder has a set screw for releasibly locking each shoulder against rotation on the hub body 26*a***.

Hub **14*a* is fixed to the shaft 12 for rotation with the shaft by means not shown. Collars 38*a* fixed on the shaft by set screws 40*a*** secure the hub against axial movement on the shaft.

Surrounding the hub **14*a* between the hub shoulders 18*a*, 20*a* is an annular elastic tire 16*a*. This tire has annular side faces 24*a* which are tapered at the same angle as and L contact the tapered hub shoulder faces 22*a*. Relative axial adjustment of the shoulders toward and away from one another is thus effective to cause radial expansion and contraction of the tire, and thereby adjustment of the tire diameter, in the same manner as described in connection with FIG. 3**.

As mentioned earlier, the adjustable diameter rollers of the invention may be used for various purposes. The particular roller 10 shown in FIG. 3 is a feed or pull-out roller for a paper handling machine. The roller **10*a* of FIG. 4** is paper creasing roller. For these uses the rollers have outer coaxial cylindrical surfaces.

FIGS. 1 and 2 illustrate the rollers 10, **10*a* installed in a paper handling machine on two parallel rotary shafts 12 mounted one over the other by bearing supports, not shown. The feed or pull-out rollers 10 are mounted on the upper shaft. The creasing rollers 10*a* are mounted on the lower shaft. Mounted on the lower shaft opposite each pull-out roller 10 is a rigid roller 100 made of steel or the like and having a coaxial cylindrical peripheral surface. Mounted on the upper shaft opposite each creasing roller 10*a* is a circular blade-like creasing wheel 102**.

A paper sheet 104, which may be paper, paperboard, cardboard, or, for that matter, any other suitable sheet material, to be creased passes between the feed or pull-out rollers 10, 100 and between the creasing rollers and wheels 102. The adjustability of the adjustable diameter feed rollers 10 of the invention permit these rollers to be precisely adjusted into the proper contact with the paper 104 to accurately and linearly feed the paper without smearing printing on the paper. Moreover, the rollers may be periodically adjusted to compensate for wear of the roller tires 16, particularly uneven wear, over a period of time. Similarly, the creasing rollers 10*a* are adjustable to locate their tires 16*a* in proper paper creasing relation to the creasing wheels 102 and to compensate for wear of the rollers.

An important advantage of the present mode of adjusting the roller diameter is that it does not significantly bulge or otherwise deform the outer roller surfaces from their cylindrical contour. This is important in the paper handling application of FIGS. 1 and 2. Thus, the feed or pull-out roll surfaces must remain cylindrical to parallel, in transverse section, the rigid roller surfaces and thereby assure proper gripping and feeding of the paper by the rollers. Similarly, the creasing roller surfaces must remain cylindrical to assure proper creasing of the paper. The optimum taper angle of the shoulder faces 22 and tire side faces 24 is 30° .

The inventor claims:

1. An adjustable diameter roller comprising:

a hub having an axis of rotation and including a pair of coaxial shoulders having conically tapered coaxial shoulder faces which face one another axially of said hub and diverge radially outward of said hub, and means for effecting relative axial adjustment of said shoulders toward and away from one another, an annular elastic tire coaxially surrounding said hub between said shoulders and having a coaxial, substantially cylindrical peripheral surface and conically tapered, radially outward diverging annular side faces contacting said hub shoulder faces, respectively, and wherein (a) said hub shoulder faces have a common uniform tapered angle over their entire surface area in contact with said tire side faces, (b) said tire side faces are conically tapered at substantially the same angles as their adjacent hub shoulder faces in the normal unstressed condition of said tire, and (c) said hub shoulders are relatively coaxially adjustable toward and away from one another to axially compress and relieve said tire and thereby effect radial expansion and contraction of the tire to adjust the outer tire diameter substantially without deformation of said peripheral tire surface from its coaxial cylindrical configuration.

2. An adjustable roller according to claim 1, wherein: said tire side faces and said hub shoulder faces have the same taper diameter.

* * * * *